US010400472B2

(12) United States Patent
Schultz

(10) Patent No.: US 10,400,472 B2
(45) Date of Patent: Sep. 3, 2019

(54) DOOR LOCKING DEVICE, ASSEMBLY AND METHOD OF CONSTRUCTING

(71) Applicant: Schultz Enterprise, LLC, Tucson, AZ (US)

(72) Inventor: Christopher M Schultz, Phoenix, AZ (US)

(73) Assignee: SCHULTZ ENTERPRISE, LLC, Tucson, AZ (US)

( * ) Notice: Subject to any disclaimer, the term of this patent is extended or adjusted under 35 U.S.C. 154(b) by 687 days.

(21) Appl. No.: 15/061,133

(22) Filed: Mar. 4, 2016

(65) Prior Publication Data

US 2017/0254126 A1 Sep. 7, 2017

(51) Int. Cl.

| | |
|---|---|
| ***E05B 9/02*** | (2006.01) |
| ***E05B 47/02*** | (2006.01) |
| ***E05B 63/00*** | (2006.01) |
| ***E05B 65/00*** | (2006.01) |
| *E05B 47/00* | (2006.01) |
| *E05B 15/16* | (2006.01) |

(52) U.S. Cl.
CPC ..... *E05B 9/02* (2013.01); *E05B 47/023* (2013.01); *E05B 63/0004* (2013.01);
(Continued)

(58) Field of Classification Search
CPC ..... E05B 9/02; E05B 15/1607; E05B 15/024; E05B 15/025; E05B 63/006;
(Continued)

(56) References Cited

U.S. PATENT DOCUMENTS 3,149,867 A * 9/1964 Odend 'Hal ..... E05B 65/0053 292/226
3,179,458 A * 4/1965 Sconzo ..... E05B 15/0245 292/341.15

(Continued)

FOREIGN PATENT DOCUMENTS

| | | | |
|---|---|---|---|
| CN | 203961492 | U | 11/2014 |
| RU | 2382861 | C1 | 2/2010 |
| WO | 2008132272 | A2 | 11/2008 |

OTHER PUBLICATIONS

International Search Report issued in related International Patent Application No. PCT/IB2016/000/318, dated Jul. 7, 2016, 2 pages.

*Primary Examiner* — Alyson M Merlino
(74) *Attorney, Agent, or Firm* — Gavin J. Milczarek-Desai; Quarles & Brady LLP

(57) ABSTRACT

A new and useful door locking device, door locking assembly, and method of constructing a door locking assembly is provided. The door locking device includes first and second subassemblies configured to connect to a door jamb and door, respectively, a first locking member connected to one of the subassemblies and a second locking member connected to the other subassembly. The first and second locking members are selectively engaged to lock the door with the jamb and selectively disengaged to unlock the door from the jamb. The connection of the second subassembly to the door being is designed to allow adjustment of the one of the locking components in a plurality of directions, to enable the door locking device to be adjusted provide a predetermined locking orientation of the first and second locking members. The connection of the first subassembly to the door jamb is designed to provide minimal, easily repaired, intrusion to the structure of the doorjamb; and the connection of the second subassembly to the door is of a type that connects to the door surface without damage to the door while providing a secure connection of the locking components when they are selectively engaged.

18 Claims, 12 Drawing Sheets

(52) U.S. Cl.
CPC ..... *E05B 65/0014* (2013.01); *E05B 15/1607* (2013.01); *E05B 63/0056* (2013.01); *E05B 2047/0048* (2013.01); *E05B 2047/0094* (2013.01)

(58) Field of Classification Search
CPC ..... E05B 63/0004; E05B 63/0056; E05B 47/023; E05B 65/0014; E05B 2047/0048; E05B 2047/0094; Y10S 292/53; Y10S 292/54; Y10S 292/60; Y10S 292/64; Y10T 292/0848; Y10T 292/0856; Y10T 292/68; Y10T 292/683; Y10T 292/696; Y10T 292/699; Y10T 292/702; Y10T 292/705; Y10T 292/707; Y10T 70/7051; Y10T 70/7062; Y10T 70/7102; Y10T 70/7113; Y10T 70/8838; Y10T 70/8973; Y10T 70/5199; Y10T 70/5204
See application file for complete search history.

(56) References Cited

U.S. PATENT DOCUMENTS 3,223,441 A * 12/1965 Fortune ..... E05B 15/025 292/341.18
3,737,184 A * 6/1973 Swartz ..... E05B 17/0037 292/341.13
3,931,723 A 1/1976 Kurtz
4,017,106 A * 4/1977 Salazar ..... E05B 15/0205 292/340
4,017,107 A * 4/1977 Hanchett ..... E05B 47/0046 292/341.16
4,305,611 A * 12/1981 Robins ..... E05B 63/0056 292/341.19
4,746,152 A * 5/1988 Willcox ..... E05B 63/128 292/341.15
4,960,297 A * 10/1990 Bouse ..... E05C 3/162 126/197
5,028,082 A 7/1991 Kronbetter
5,352,001 A * 10/1994 Shieh ..... E05B 15/025 292/341.18
5,941,106 A * 8/1999 Williamson, Jr. .... E05B 15/024 292/144
6,301,941 B1 * 10/2001 Nicholsfigueiredo .. E05B 13/04 292/150
2002/0060460 A1 * 5/2002 DeSouza ..... E05B 65/0007 292/238
2005/0235711 A1 * 10/2005 Martin ..... E05B 65/08 70/100
2010/0045055 A1 * 2/2010 Taglianetti ..... E05B 15/0205 292/341.15

* cited by examiner

Figue 1

DOOR LOCKING DEVICE, ASSEMBLY AND METHOD OF CONSTRUCTING

RELATED APPLICATION/CLAIM OF PRIORITY

This application is related to and claims priority from provisional application Ser. No. 62/177,103, filed Mar. 5, 2015, which provisional application is incorporated by reference herein.

BACKGROUND

The present invention provides a new and useful door locking device, door locking assembly, and method of constructing a door locking assembly.

In the applicant's experience, a young child being able to open a door can be a dangerous condition. As an example, the front door of a home or apartment can be a particular place of worry, if a young child could unlock even a deadbolt and open the door. Thus, applicant perceived an important need for a way to secure the door in a way that a young child could not reach and unlock. In addition, when the door is an apartment door, and the tenant may risk issues with a landlord if the tenant damages the door, providing an apartment door with a way to secure the door in a way that does minimal damage to the door and still achieves applicant's basic objective of preventing a child from opening the door presented an additional challenge. In addition, with many elderly building occupants, e.g. in an assisted living environment, a nursing home environment the same types of concerns and issues can also present themselves, particularly with respect to mentally impaired residents (e.g. Alzheimer patients).

Applicant's solution to those concerns and issues have led to a new and useful way of accomplishing those objectives; i.e. provide a secure way of locking a door in a way that prevents a child or elderly person (e.g. a mentally impaired patient) from opening the door when they should not be opening it, and accomplishing that objective in a way that minimizes damage to the door structure. Applicant has provided a new and useful door locking device, door locking assembly, and method of constructing a door locking assembly that achieve those objectives.

Applicant's invention is designed to not allow children or persons with mental issues to open a hinged door and exit or enter a room or a house. The invention is also designed so as the person leaves or enters they can secure the door. The remote capability allows only persons with the activation or deactivation remote to control the lock and unlock of the device. The main entrance of the house is the primary place for this device so those persons or children are not able to get outside but the second important place is for the bathroom door adding security to the medicine cabinet. Another useful place is a closet door that contains chemicals. Unlike a deadbolt that everyone can reach even a small child on a chair the locking device of the present invention can be mounted high on the door and jamb and can be remote controlled. It gives security to a parent or family member that the person or child cannot get out of or into areas without permission to do so.

SUMMARY OF THE INVENTION

According to the invention, a door locking device includes first and second subassemblies configured to connect to a door jamb and door, respectively, a first locking member connected to one of the subassemblies and a second locking member connected to the other subassembly. The first and second locking members are selectively engaged to lock the door with the jamb and selectively disengaged to unlock the door from the jamb. The connection of the second subassembly to the door being is designed to allow adjustment of the one of the locking components in a plurality of directions, to enable the door locking device to be adjusted provide a predetermined locking orientation of the first and second locking members. The connection of the first subassembly to the door jamb is designed to provide minimal, easily repaired, intrusion to the structure of the door jamb; and the connection of the second subassembly to the door is of a type that connects to the door surface without damage to the door while providing a secure connection of the locking components when they are selectively engaged.

In a preferred version of the device, a. the second subassembly is connected to the inside surface of the door and the second locking member comprises a locking bar extending substantially parallel to the inside surface of the door, and the second subassembly is configured to allow selective adjustment of the locking bar in a direction parallel to the surface of the door and a second direction perpendicular to the surface of the door.

b. the first subassembly comprises a base member, a pivotal locking member connected with the base member, and a cover assembly connected with the base member and combined with the base member to form a housing for the pivotal locking member. The cover assembly and also forms a slot into which the locking bar of the second subassembly fits in a predetermined orientation when the door is in a closed position, and the pivotal locking member is pivotal between a locking position in which it engages the locking bar and prevents movement of the locking bar away from the door jamb, thereby to lock the door to the door jamb, and an unlocked position in which the locking bar on the second subassembly can move through the slot and in a direction away from the first subassembly to enable the door to be opened.

c. Also, the pivotal locking member is servo controlled, and the servo control of the pivotal locking member is and can be remotely controlled. The first subassembly is connected to the sides of the door jamb by one or more fasteners, and the second subassembly is connected to the inside surface of the door by a connecting strip that is adhesively secured to the inside surface of the door. The second subassembly is configured to allow selective adjustment of the locking bar in two directions parallel to the surface of the door and in a direction perpendicular to the surface of the door. The second subassembly is also configured to allow selective adjustment of the locking bar in an angular direction relative to the surface of the door.

In a door locking assembly, according to the invention, the first and second support components are connected to a door jamb and door, respectively, and the locking members function in the manner set forth above.

In a method of constructing a door locking assembly, according to the invention, the door locking device, as described above, is provided, the first and second subassemblies are connected to a door jamb and door, respectively, and the locking members function in the manner set forth above.

These and other features of the present invention will be further apparent from the following detailed description and the accompanying drawings.

DETAILED DESCRIPTION

Figure 1:
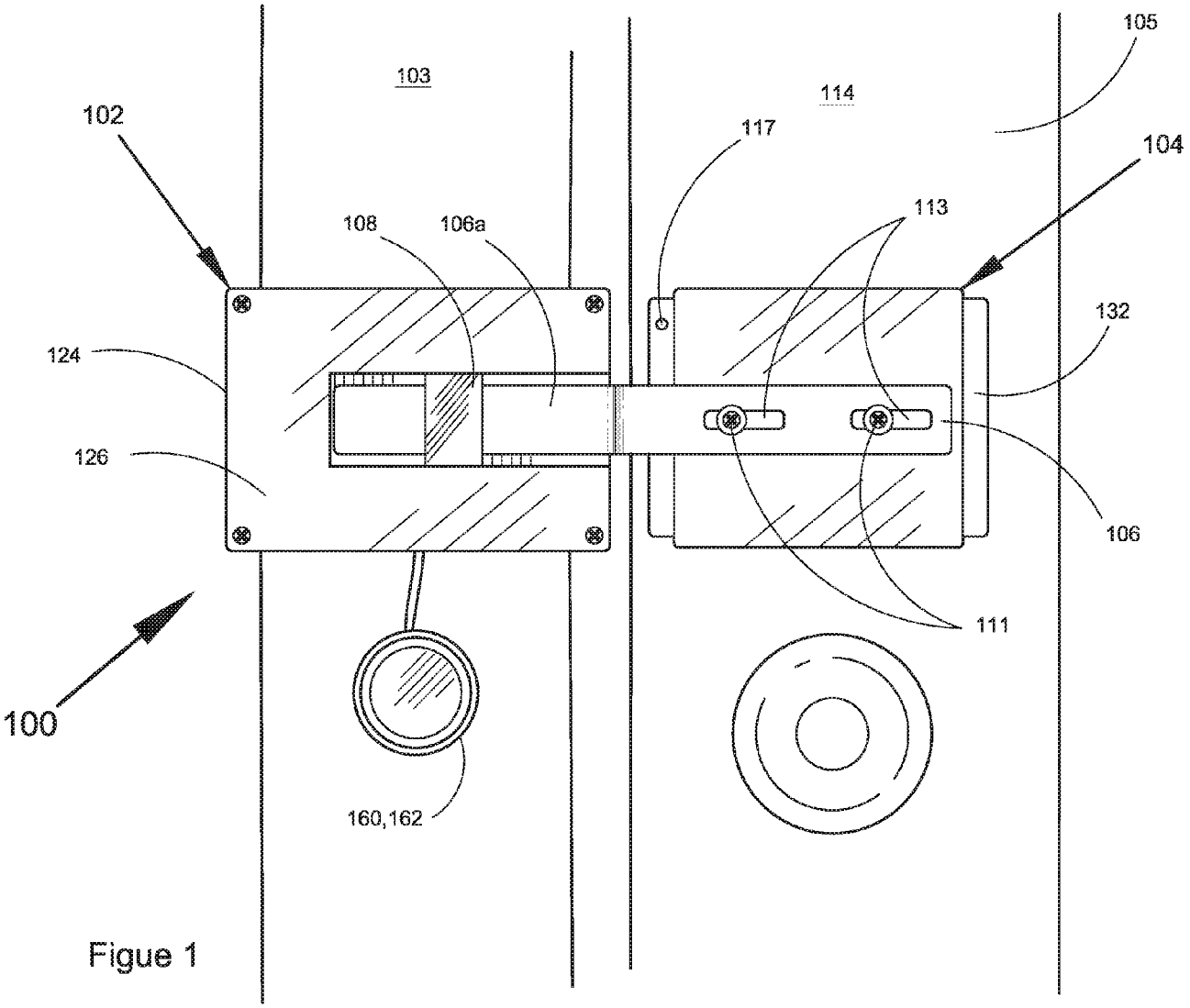
FIG. 1 is a schematic illustration of a door and door jamb, with a door locking assembly that includes a locking device, according to the present invention, in a locked condition.

As described above, the present invention relates to a new and useful structure and method of providing a secure way of locking a door in a way that prevents a child or elderly (e.g. mentally impaired) person from opening the door when they should not be opening it, and accomplishing that objective in a way that minimizes damage to the door structure. The invention is described herein in connection with a door and jamb of an apartment door, and from that description, the manner in which the principles of the present invention can be applied to various other types of door structures will be apparent to those in the art.

Referring to FIGS. 1-8, 10, 11, a door locking assembly 100 includes first and second subassemblies 102, 104, configured to connect to a door jamb 103 and door 105, respectively. A first locking member, in the form of a locking bar 106 forms part of the second subassembly 104 and a second locking member, in the form of a pivotal latch 108, forms part of the first subassembly 102. The first and second locking members 106, 108, are selectively engaged (the pivotal latch pivots to a position in which it overlies the locking bar) to lock the door with the jamb and selectively disengaged (by movement of the pivotal member) to unlock the door from the jamb.

Figure 2:
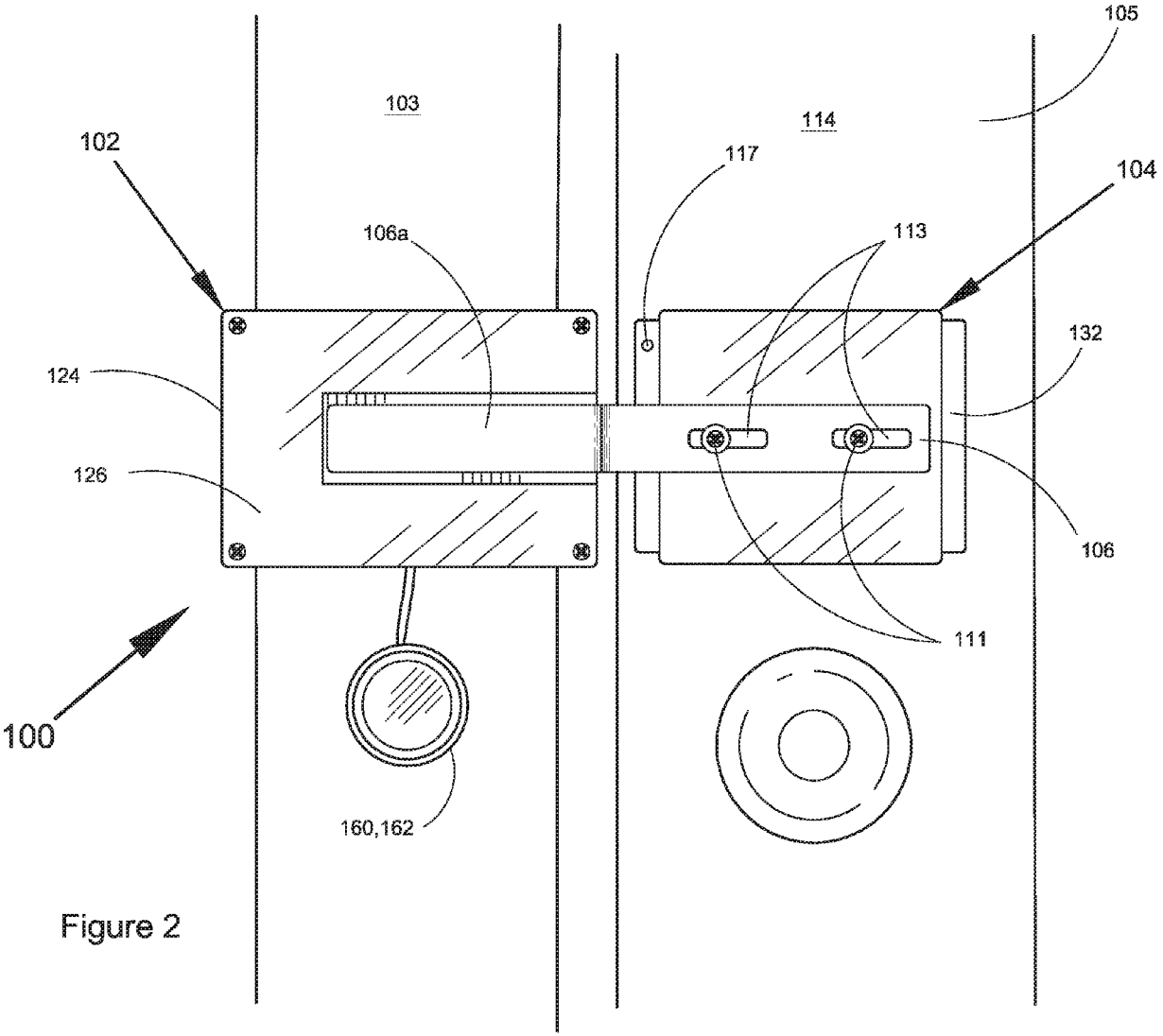
FIG. 2 is a schematic illustration of the door locking assembly of FIG. 1, with the locking device in an unlocked condition.
Figure 3:
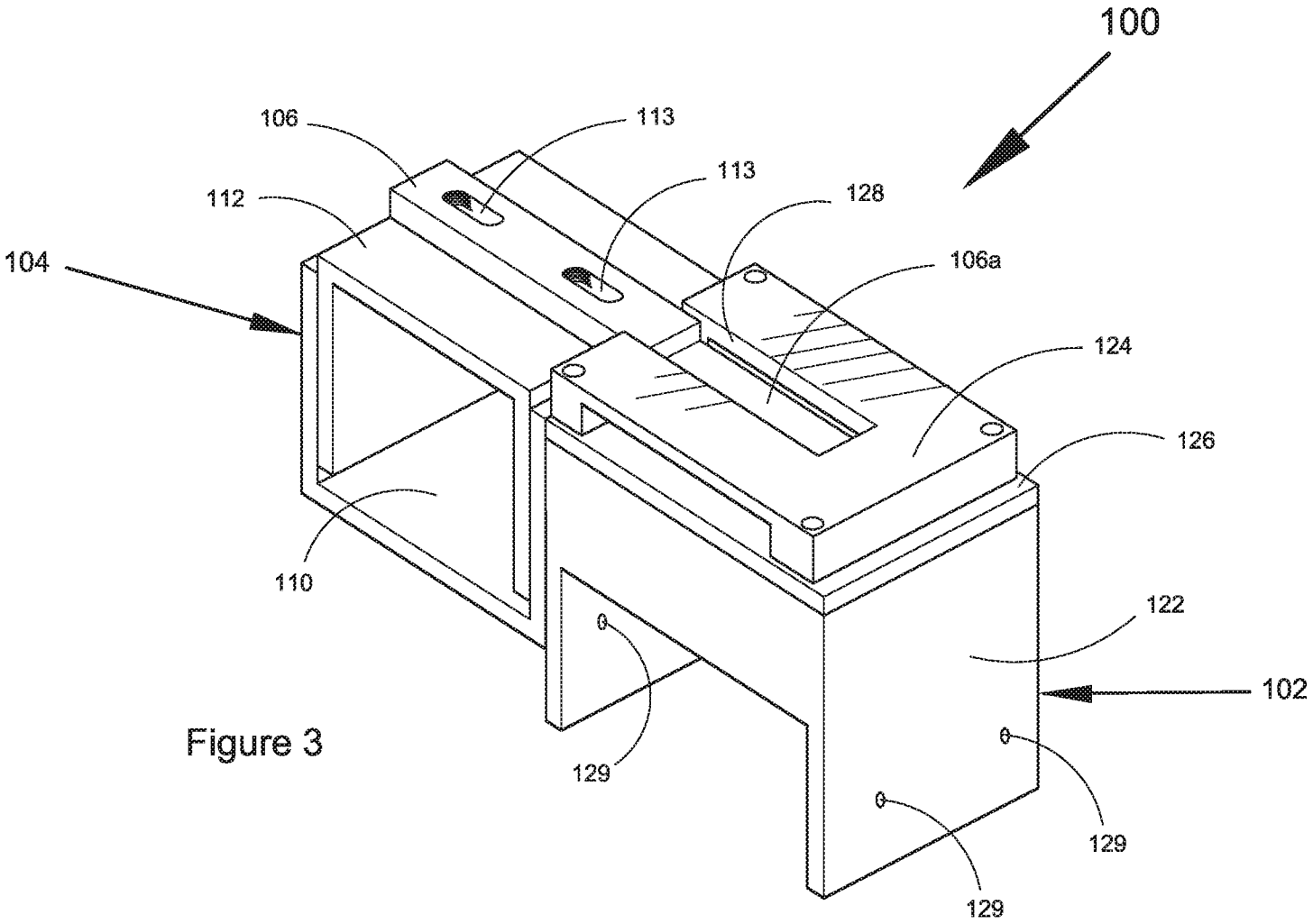
FIG. 3 is a three dimensional view of the door locking assembly of the present invention.
Figure 4:
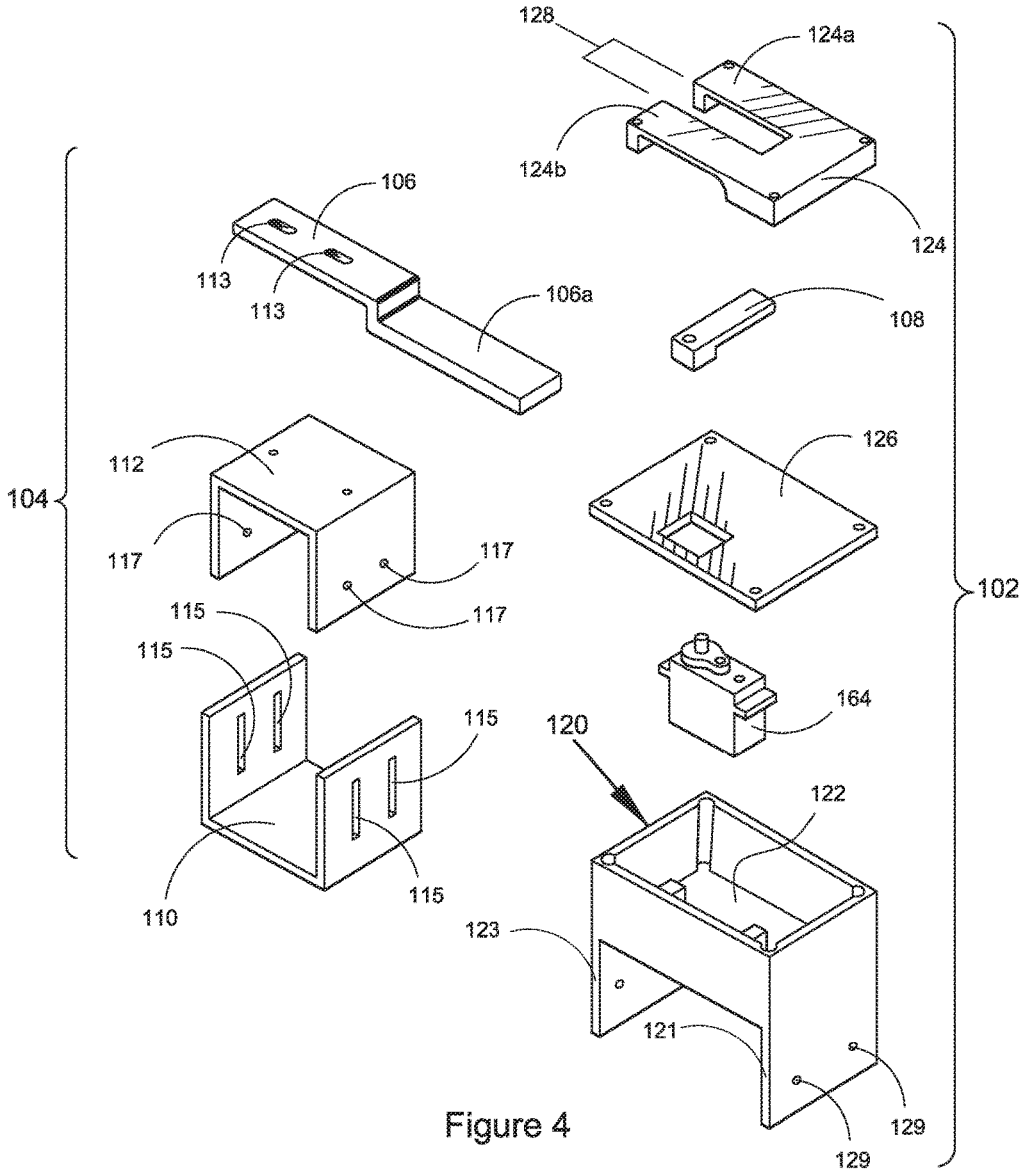
FIG. 4 is an exploded view of the components of the door locking assembly of FIG. 4.
Figure 5B:
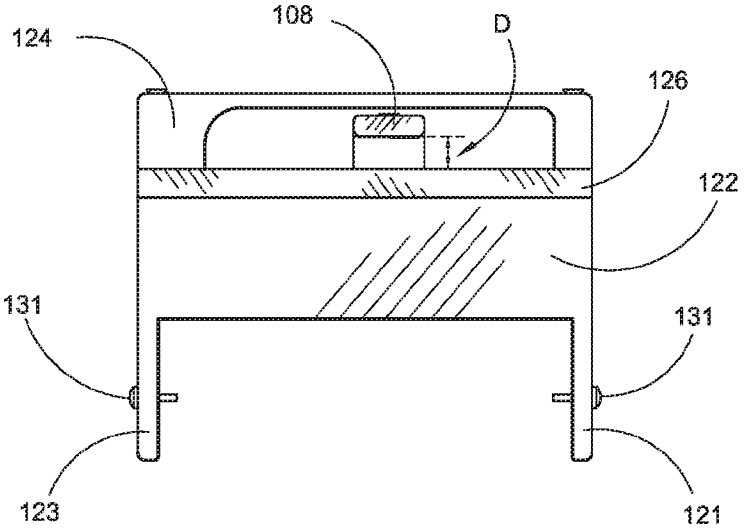
FIGS. 5*a* and 5*b* are side views of components of the door locking assembly of the present invention, with the pivotal locking member in the unlocked position (FIG. 5*a*) and the locked position (FIG. 5*b*)
Figure 5A:
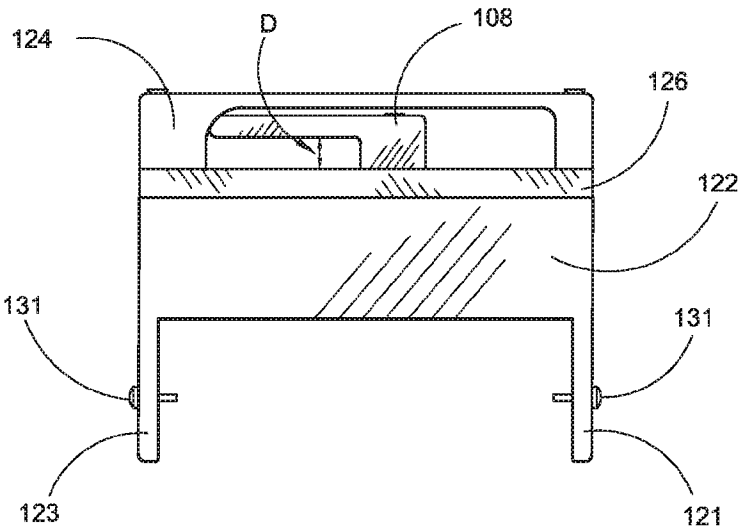
Figure 6B:
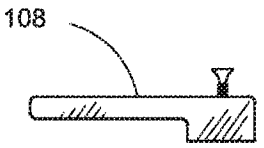
FIGS. 6*b* and 6*c* are side and top views, respectively, of the pivotal locking member.
Figure 6C:
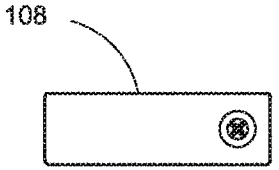
Figure 6A:
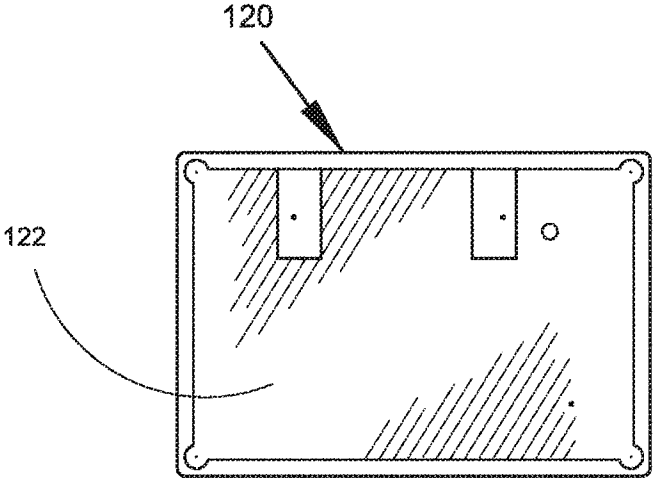
FIG. 6*a* is a top view of the housing component that supports the pivotal locking member of the door locking assembly of the present invention.
Figure 7B:
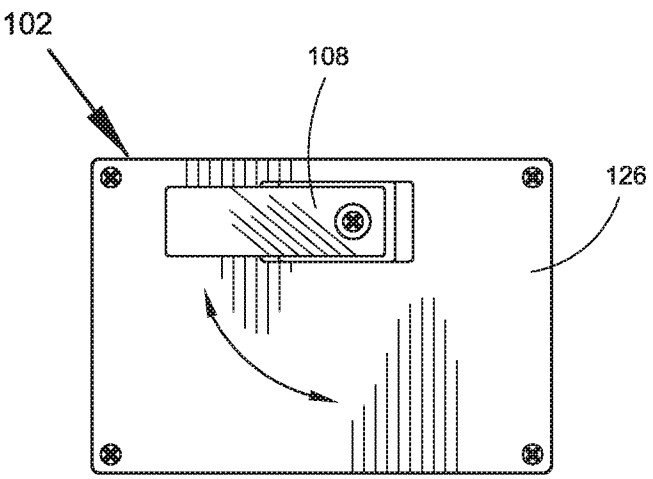
FIGS. 7*a* and 7*b* are partial top views of the pivotal locking member (that forms part of the jamb subassembly 102) in a locked position (FIG. 7*a*) and unlocked position (FIG. 7*b*)
Figure 7A:
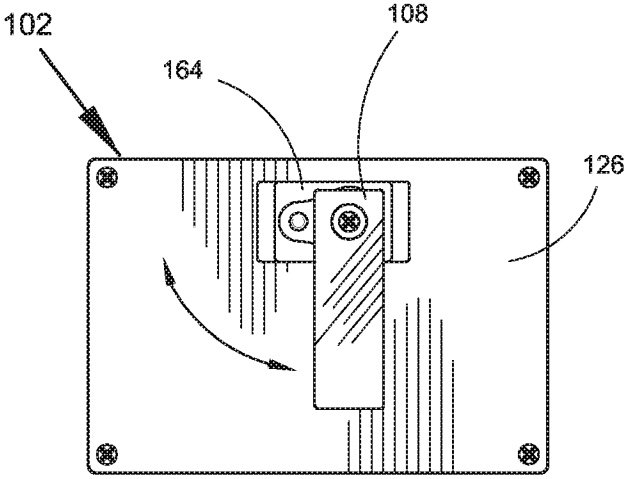
Figure 7D:
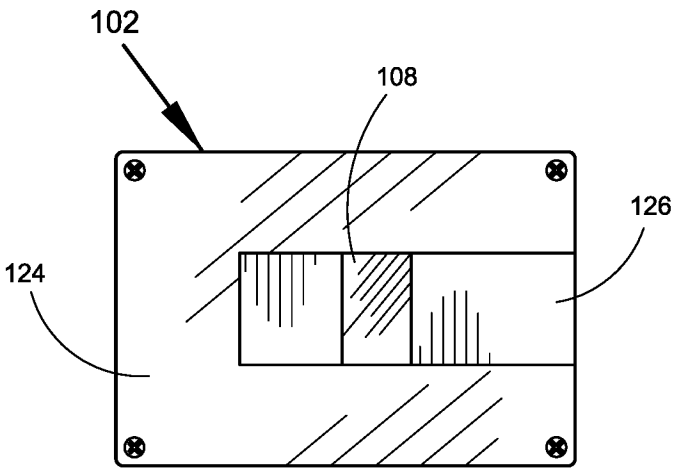
FIGS. 7*c* and 7*d* are top views of the pivotal locking member assembled with the cover plate and with the pivotal locking member in the locked position (FIG. 7*d*) and unlocked position (FIG. 7*c;*
Figure 7C:
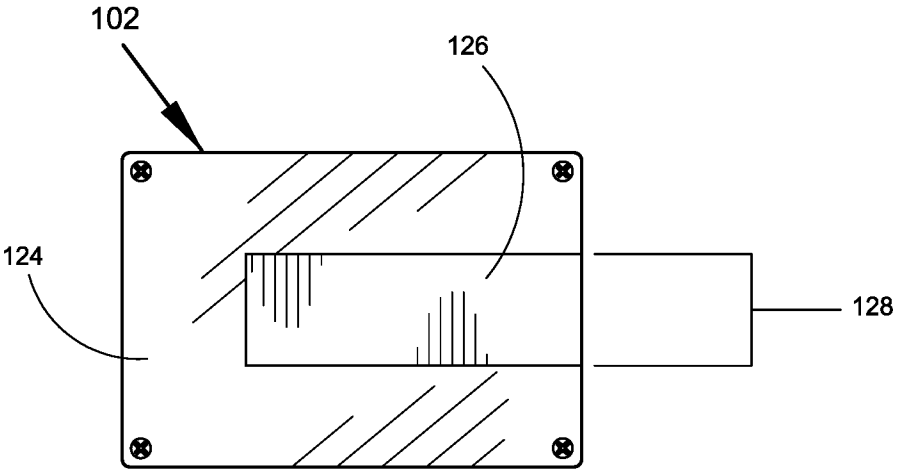

The structure of the second subassembly 104, and its connection to the door 105 is designed to allow adjustment of the locking bar 106 in a plurality of directions, to enable the door locking device to be adjusted provide a predetermined locking orientation of the first and second locking members. Specifically, the locking bar 106 has a locking portion 106*a*, the second subassembly includes a pair of interfitting U shaped components 110, 112 and the locking bar 100 is fastened to the U shaped component 112. Specifically, as seen in FIGS. 1-3, the top part 112*a* of the locking bar 106 has slots 113 in which locking screws 111 are received, and allow adjustment of the locking bar in directions parallel to the surface 114 of the door. The interfitting U shaped components 110 112 have pairs of slots 115 extending perpendicular to the surface of the door, and adjustment screws 117 connected with those slots that enable adjustment of the U shaped components in directions perpendicular to the surface 114 of the door and also allow some degree of angular adjustment of the U shaped components, to thereby provide selective adjustment of the locking bar in directions perpendicular to the door surface 114 and also angular adjustment of the locking bar 106 relative to the door surface. Thus, there are effectively six points of adjustment for the locking bar 106, so that when the subassemblies 102, 104 are connected to the door jamb and door, the locking bar and the U shaped components can be selectively adjusted to adjust the position of the locking bar 106 (and particularly the locking bar portion 106*a*) in directions parallel to, perpendicular to, and angularly relative to the surface 114 of the door.

The first subassembly 102 comprises a housing 120 with a pair of parallel legs 121, 123, a compartment 122 in which the pivotal latch 108 (which is servo controlled) is located, a top plate 126 on top of the compartment 122, and a cover plate 124 on top of the top plate. The cover plate 124 has a pair of legs 124*a*, 124*b* that define a slot 128 for receiving the locking bar portion 106*a* and allowing the locking bar portion 106*a* to move with the door when the locking device is unlocked and the door is being opened or closed). The pivotal latch 108 is pivotal in the slot between locking position (FIG. 1) and an unlocking position (FIG. 2. The pivotal latch 108 is spaced from the top plate 126 (e.g. by a distance D in FIGS. 5*a*, 5*b*) to define part of the slot 128 for receiving the locking bar portion 106*a*. That Distance D is close to the thickness of the locking bar portion 106*a* that will be received in the slot 128, so that the locking bar portion 106*a* of the locking bar will extend into the slot 128 and lie flat against the top plate 126 when the pivotal latch 108 is pivoted to a position in which it lies over and across the locking bar portion 106*a* to lock the door and the jamb. The adjustment of the locking bar 106 relative to the door, by the six points of adjustment described above, is designed to enable the locking bar portion 106*a* to be selectively adjusted, to accommodate different jamb configurations, and also insure that the locking bar portion 106*a* will fit securely in the slot 128 and against the top cover 126, so that when the pivotal latch 108 is pivoted to a locking position, it will overlie the locking bar portion 106*a* and lock door and jamb.

The connection of the first subassembly 102 to the door jamb 103 is designed to provide minimal, easily repaired, intrusion to the structure of the door jamb; and the connection of the second subassembly 104 to the door 105 (essentially to the inside surface 114 of the door) is of a type that connects to the door surface without damage to the door while providing a secure connection of the locking components when they are selectively engaged. Specifically, the legs 121, 123 of the housing 120 are spaced apart to accommodate a typical door jamb width, and have holes 129 through which locking screws 131 can extend to couple the first subassembly 102 to the sides of a door jamb. The use of locking screws 131 provides minimal, easily repaired intrusion to the structure of the door jamb, because all that is required is to remove the screws and spackle the screw holes.

Figure 8:
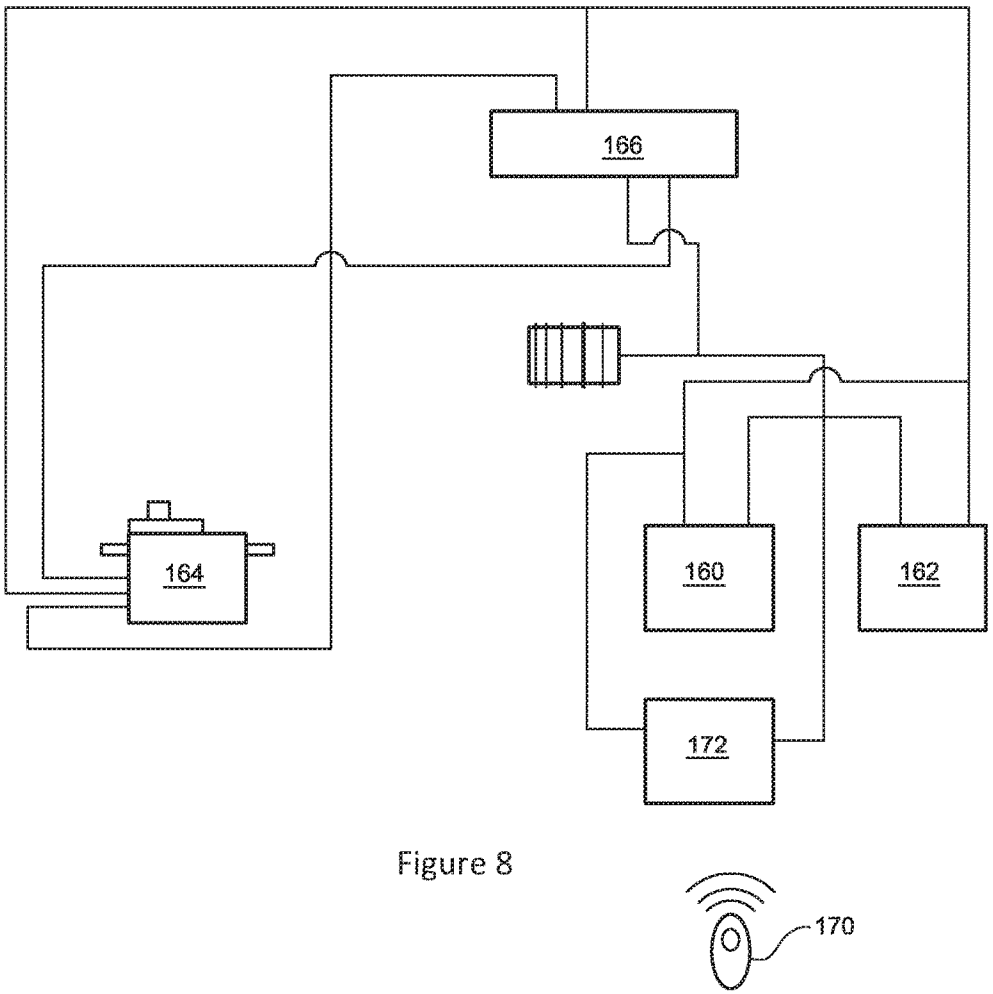
FIG. 8 is a circuit diagram of the servo controls for a door locking device of the present invention.
Figure 11B:
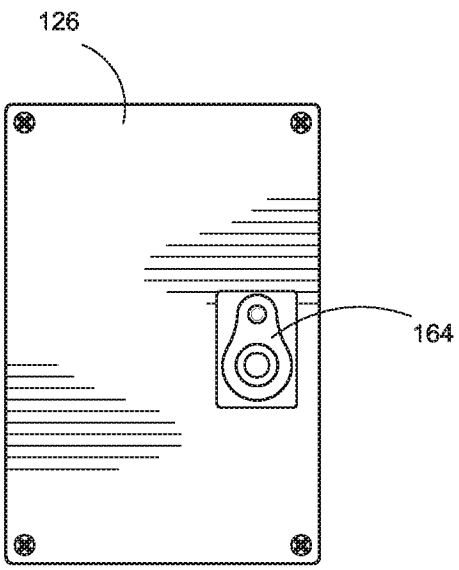
FIGS. 11*a* and 11*b* are a partial schematic illustrations of the part of the jamb subassembly 102 that can contain the servo and controller for operating the pivotal latch.
Figure 11A:
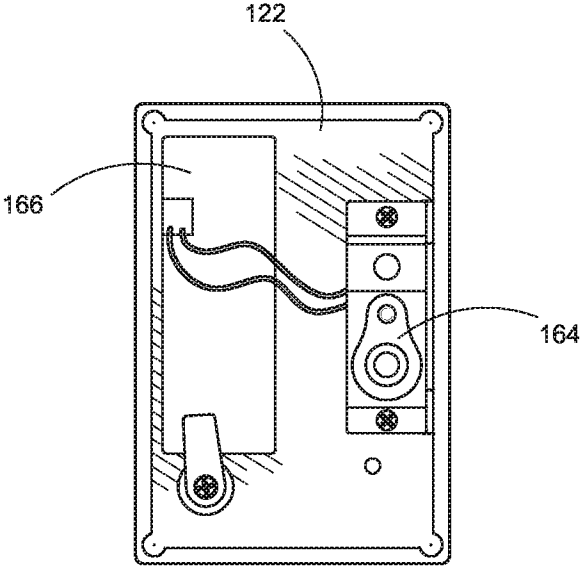

In a preferred version of the device, a. the second subassembly 104 is connected to the inside surface 114 of the door (e.g. by an adhesive strip 132, also referred to as "mounting tape", that extends away from the U shaped housing member 110) and the locking bar 106 extends substantially parallel to the inside surface 114 of the door. The connection of the locking bar 106 to the U shaped housing member 110 allows selective adjustment of the locking bar in a direction parallel to the surface 114 of the door. The connections between the U shaped housing members 110, 112 allows selective adjustment of the locking bar in directions perpendicular to and also angular in relation to the surface of the door, thereby providing the 6 points of adjustment of the locking bar 106 relative to the door and the first subassembly 102.

b. The first subassembly 102 comprises the housing 120, the pivotal locking member (latch) 108 connected with the housing (and located in the compartment 122 in the housing member), and a cover assembly (formed by the top plate 126 and the cover plate 124) connected with the housing member 120, covering the compartment 122) and combined with the housing to contain the pivotal latch 108. The top cover 124 has the slot 128 into which the locking bar portion 106*a* of the second subassembly fits in a predetermined orientation when the door is in a closed position, and the pivotal latch 108 is pivotal between a locking position (FIG. 1) in which it overlies the locking bar portion 106*a* and prevents movement of the locking bar away from the door jamb 103, thereby to lock the door to the door jamb, and an unlocked position (FIG. 2) in which the locking bar portion 106*a* on the second subassembly can move through the slot 128 and in a direction away from the first subassembly 102 to enable the door to be opened.

c. Also, the pivotal locking member 108 is servo controlled, and the servo control of the pivotal locking member can be manually or remotely controlled (e.g. by a remote controller 170 that communicates control signals to a receiver 172 which relates those control signals to a controller 166 for a servo 164 that controls the pivotal latch 108). As shown in FIGS. 8, 11*a* and 11*b*, the servo 164 can be located in the compartment 122 on the housing 120. As shown in the circuit diagram of FIG. 8, a pair of switches 160, 162 can manually control the servo 164, so that the locking device can be manually locked when desired. As further shown in FIG. 8, the switches 160, 162 can be remotely controlled, so that the locking device can be controlled from inside or outside the door.

Also, it should be noted that the locking device can be placed high enough on the door and the jamb so that it is out of reach of young children, and many elderly persons with mental conditions that make it desirable to control their access to the locking device.

Thus, the locking device of the invention is designed to minimize access to the locking device by children or persons with mental issues and thereby limits their ability to open a hinged door and exit or enter a room or a house when they are not supposed to do that. The locking device of the invention is also designed so as the person overseeing the child or person with mental issues leaves or enters they can secure the door. The remote capability allows only persons with the activation or deactivation remote (i.e. the overseeing person) to control the lock and unlock of the device. The main entrance of the house is the primary place for this device so those persons or children are not able to get outside but the second important place is for the bathroom door adding security to the medicine cabinet. Another useful place is a closet door that contains chemicals. Unlike a deadbolt that everyone can reach even a small child on a chair the locking device of the present invention can be mounted high on the door and jamb and can be remote controlled. It gives security to a parent or family member that the person or child cannot get out of or into areas without permission to do so.

In a door locking assembly, according to the invention, the first and second support components are connected to a door jamb and door, respectively, and the locking members function in the manner set forth above.

Figure 9:
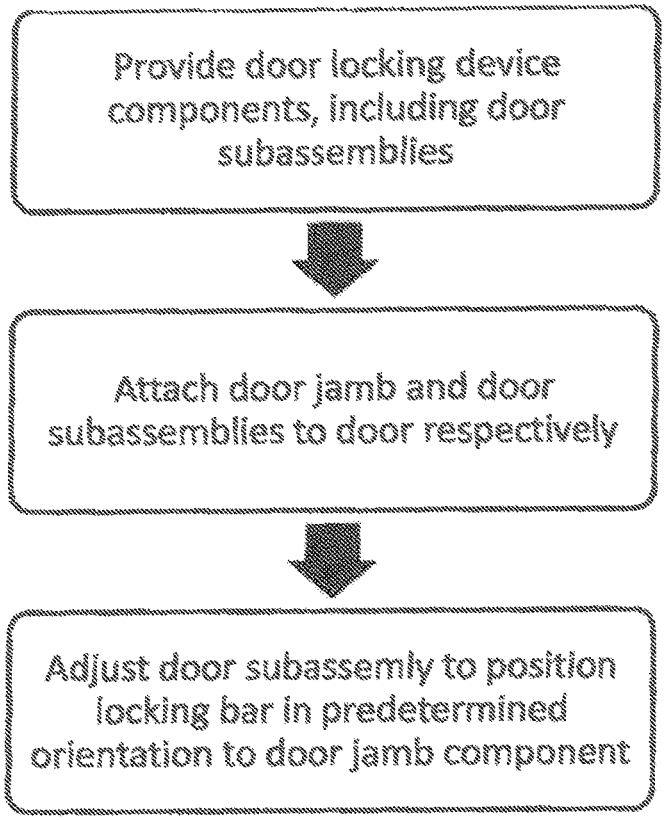
FIG. 9 is an illustration of the method of constructing (assembling) a door locking assembly with the door locking mechanism.
Figure 10:
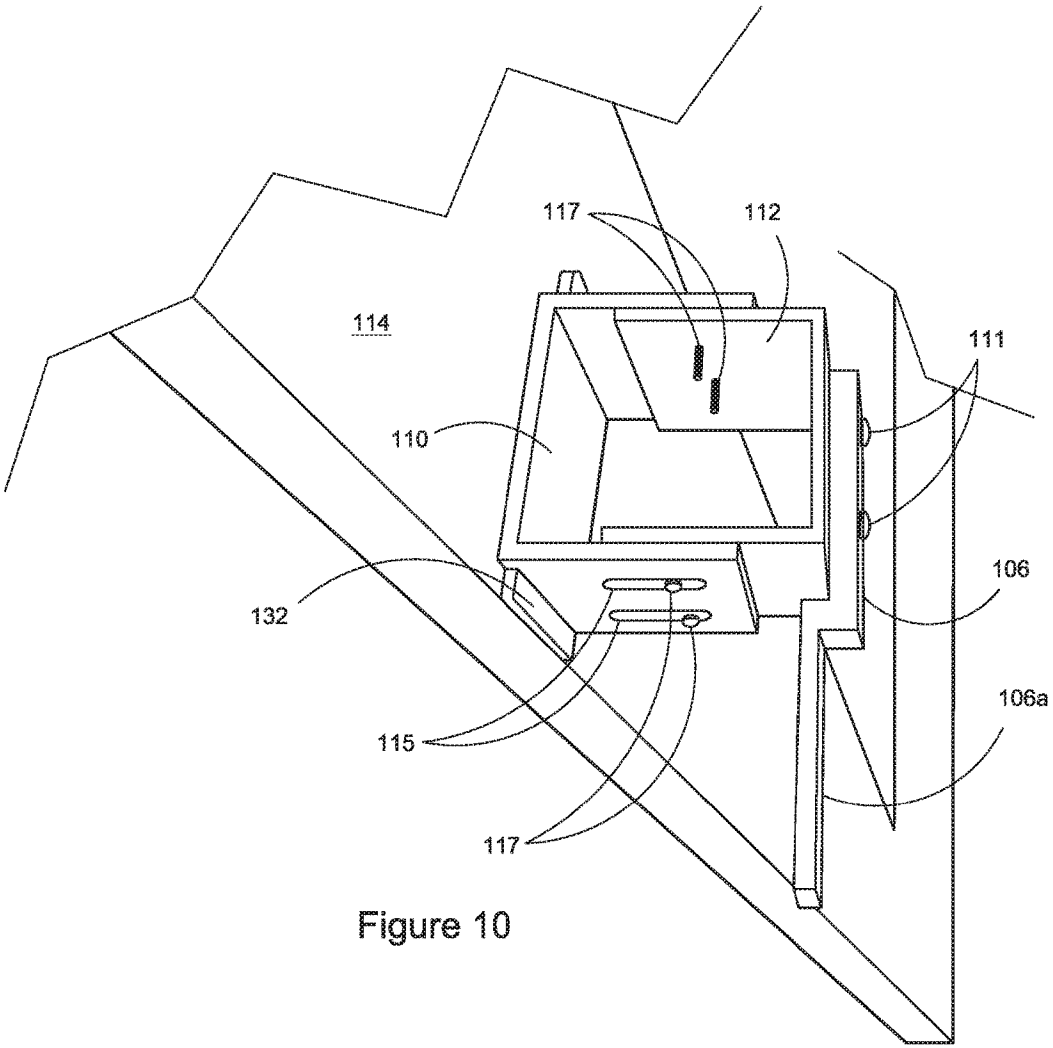
FIG. 10 is a schematic illustration of the manner in which the door subassembly is coupled to a door surface, in accordance with the invention.

As shown in FIG. 9, in a method of constructing the door locking assembly, according to the invention, the door locking device, as described above, is provided, the first and second subassemblies are connected to a door jamb and door, respectively, and the locking bar is adjusted (e.g. by adjustment of the locking bar on the housing member 112, and/or adjusting the U shaped housing members 110, 112 to adjust the perpendicular or angular position of the locking bar relative to the door surface, so that when the door is closed, the locking bar will fit into the slot in the second subassembly, and lie against the top plate of the second subassembly. With this adjustment, the locking device will provide a safe and secure lock when desired. The adhesive strip 132 that secures the first subassembly to the door surface, along with the subassembly structures described herein, provides effective resistance to movement of the door in an opening direction when the pivotal latch has been moved to a position in which it locks the subassemblies against movement that would open the door.

The invention claimed is:

1. A door locking device that includes first and second subassemblies configured to connect to a door jamb and a door, respectively, the second subassembly including a pair of interfitting substantially U shaped components, a first locking member forming part of one of the first and second subassemblies and a second locking member forming part of the other of the first and second subassemblies; the first and second locking members being selectively engaged to lock the door with the door jamb and selectively disengaged to unlock the door from the door jamb; the connection of the second subassembly to the door being designed to allow adjustment of the one of the first and second locking members forming part of the second subassembly in a plurality of directions, to enable the door locking device to be adjusted to provide a predetermined locking orientation of the first and second locking members; the connection of the first subassembly to the door jamb being designed to be removably attachable to a structure of the door jamb; and the connection of the second subassembly to the door being configured to connect to a door surface without damage to the door while providing a secure connection of the first and second locking members when they are selectively engaged, wherein the door surface to which the second subassembly is connected is an inside surface of the door and the second locking member is connected to one of the pair of interfitting substantially U-shaped components, the second locking member comprising a locking bar extending substantially parallel to the inside surface of the door, and the second subassembly is configured to allow selective adjustment of the locking bar in a direction parallel to the inside surface of the door and a second direction perpendicular to the inside surface of the door; and wherein the first locking member comprises a pivotal locking member, the first subassembly comprises a base member, the pivotal locking member connected with the base member, and a cover assembly connected with the base member and combined with the base member to form a slot into which the locking bar of the second subassembly fits in a predetermined orientation when the door is in a closed position, and the pivotal locking member being pivotal between a locking position, in which the pivotal locking member engages the locking bar and prevents movement of the locking bar away from the door jamb, thereby locking the door to the doorjamb, and an unlocked position, in which the locking bar can move through the slot and in a direction away from the first subassembly to enable the door to be opened.

2. The door locking device of claim 1, wherein the pivotal locking member is servo controlled.

3. The door locking device of claim 2, wherein the servo control of the pivotal locking member can be remotely controlled.

4. The door locking device of claim 1, wherein the first subassembly is connected to sides of the door jamb by one or more fasteners, and the second subassembly is connected to the inside surface of the door by a connecting strip that is adhesively secured to the inside surface of the door.

5. The door locking device of claim 1, wherein the second subassembly is configured to allow selective adjustment of the locking bar in an additional direction parallel to the inside surface of the door.

6. The device of claim 1, wherein one of the pair of interfitting substantially U shaped components has pairs of slots extending perpendicular to the door surface.

7. A door locking assembly that includes first and second subassemblies connected to a door jamb and a door, respectively, the second subassembly including a pair of interfitting substantially U shaped components, a first locking member forming part of one of the first and second subassemblies and a second locking member forming part of the other of the first and second subassemblies; the first and second locking members being selectively engaged to lock the door with the door jamb and selectively disengaged to unlock the door from the door jamb; the connection of the second subassembly to the door being designed to allow adjustment of the one of the first and second locking members forming part of the second subassembly in a plurality of directions, to enable the door locking device to be adjusted to accommodate different door jamb configurations; the connection of the first subassembly to the door jamb being designed to be removably attachable to a structure of the door jamb; and the connection of the second subassembly to the door being of a type that connects to a door surface without damage to the door while providing a secure connection of the first and second locking members when they are selectively engaged, wherein the door surface to which the second subassembly is connected is an inside surface of the door and the second locking member is connected to the second subassembly, the second locking member comprising a locking bar extending substantially parallel to the inside surface of the door, and the second subassembly is configured to allow selective adjustment of the locking bar in a direction parallel to the inside surface of the door and a second direction perpendicular to the inside surface of the door; and wherein the first locking member comprises a pivotal locking member, the first subassembly comprises a base member, the pivotal locking member is connected with the base member, and a cover member connected with the base member and combined with the base member to form a housing for the pivotal locking member, the first subassembly including a slot into which the locking bar of the second subassembly fits when the door is in a closed position, and the pivotal locking member being pivotal between a locking position, in which the pivotal locking member engages the locking bar and prevents movement of the locking bar away from the doorjamb, thereby locking the door to the doorjamb, and an unlocked position, in which the locking bar on the second subassembly can move through the slot and in a direction away from a surface of the door jamb to enable the door to be opened.

8. The door locking assembly of claim 7, wherein the pivotal locking member is servo controlled.

9. The door locking assembly of claim 8, wherein the servo control of the pivotal locking member can be remotely controlled.

10. The door locking assembly of claim 7, wherein the first subassembly is connected to sides of the door jamb by one or more fasteners, and the second subassembly is connected to the inside surface of the door by a connecting strip that is adhesively secured to the inside surface of the door.

11. The door locking assembly of claim 7, wherein the second subassembly is configured to allow selective adjustment of the locking bar in an additional direction parallel to the inside surface of the door.

12. The assembly of claim 7, wherein one of the pair of interfitting substantially U shaped components has pairs of slots extending perpendicular to the door surface.

13. A method of constructing a door locking assembly comprising: providing a door locking device that includes first and second subassemblies configured to connect to a door jamb and a door, respectively, the second subassembly including a pair of interfitting substantially U shaped components, a first locking member connected to one of the first and second subassemblies and a second locking member connected to the other of the first and second subassemblies; the first and second locking members being selectively engaged to lock the door with the door jamb and selectively disengaged to unlock the door from the door jamb; the connection of the second subassembly to the door being designed to allow adjustment of the one of the first and second locking members connected to the second subassembly in a plurality of directions, to enable the door locking device to be adjusted to accommodate different door jamb configurations; the connection of the first subassembly to the door jamb being designed to be removably attachable to a structure of the door jamb; and a connection of one of the pair of interfitting substantially U shaped components to the door being of a type that connects to a door surface without damage to the door while providing a secure connection of the first and second locking members when they are selectively engaged; and connecting the first subassembly to the door jamb and connecting the second subassembly to the surface of the door associated with the door jamb, wherein the door surface to which the second subassembly is connected is an inside surface of the door and the second locking member is connected to the second subassembly, the second locking member comprising a locking bar extending substantially parallel to the inside surface of the door, and the second subassembly is configured to allow selective adjustment of the locking bar in a direction parallel to the inside surface of the door and a second direction perpendicular to the inside surface of the door; and wherein the first locking member comprises a pivotal locking member, the first subassembly comprises a base member, the pivotal locking member connected with the base member, and a cover member connected with the base member and combined with the base member to form a housing for the pivotal locking member, the first subassembly including a slot into which the locking bar of the second subassembly fits when the door is in a closed position, and the pivotal locking member being pivotal between a locking position, in which the pivotal locking member engages the locking bar and prevents movement of the locking bar away from the doorjamb, thereby locking the door to the doorjamb, and an unlocked position, in which the locking bar on the second subassembly can move through the slot and in a direction away from the door jamb to enable the door to be opened.

14. The method of claim 13, wherein the pivotal locking member is servo controlled.

15. The method of claim 14, wherein the servo control of the pivotal locking member is remotely controlled.

16. The method of claim 13, wherein the first subassembly is connected to sides of the door jamb by one or more fasteners, and the second subassembly is connected to the inside surface of the door by a connecting strip that is adhesively secured to the inside surface of the door.

17. The method of claim 13, wherein the second subassembly is configured to allow selective adjustment of the locking bar in an additional direction parallel to the inside surface of the door.

18. The method of claim 13, wherein one of the pair of interfitting substantially U shaped components has pairs of slots extending perpendicular to the door surface.

* * * * *